US011629037B2

(12) United States Patent
Hudson

(10) Patent No.: US 11,629,037 B2
(45) Date of Patent: Apr. 18, 2023

(54) MOBILE LIFT COLUMN CABLE SUSPENSION BRACKET AND ASSOCIATED METHOD

(71) Applicant: ARI Phoenix, Inc., Lebanon, OH (US)

(72) Inventor: Gareth Y. Hudson, Terrace Park, OH (US)

(73) Assignee: ARI Phoenix, Inc., Lebanon, OH (US)

( * ) Notice: Subject to any disclaimer, the term of this patent is extended or adjusted under 35 U.S.C. 154(b) by 144 days.

(21) Appl. No.: 17/020,259

(22) Filed: Sep. 14, 2020

(65) Prior Publication Data

US 2020/0407204 A1 Dec. 31, 2020

Related U.S. Application Data

(63) Continuation-in-part of application No. 15/967,640, filed on May 1, 2018, now Pat. No. 10,773,936.

(60) Provisional application No. 62/501,964, filed on May 5, 2017.

(51) Int. Cl.
*B66F 3/46* (2006.01)
*B66F 7/28* (2006.01)

(52) U.S. Cl.
CPC . *B66F 3/46* (2013.01); *B66F 7/28* (2013.01)

(58) Field of Classification Search
CPC ..... B66F 3/46; B66F 7/20; B66F 7/28
See application file for complete search history.

(56) References Cited

U.S. PATENT DOCUMENTS 6,315,079 B1 11/2001 Berends et al.
6,634,461 B1 10/2003 Baker
8,083,034 B2 * 12/2011 Bordwell ..... B66F 7/20 187/210
9,580,284 B2 2/2017 Helmich
9,611,128 B2 4/2017 Van Houten et al.
9,902,599 B1 2/2018 Veresko
10,773,936 B2 9/2020 Hudson
2002/0175319 A1 11/2002 Green
2004/0022611 A1 * 2/2004 Finkbeiner ..... B66F 7/28 414/458
2004/0031953 A1 2/2004 Leggett
2005/0279581 A1 12/2005 Koch
2007/0283854 A1 12/2007 Taylor
2015/0232309 A1 8/2015 Jaipaul
2016/0244204 A1 8/2016 DeBattiste
2017/0369291 A1 12/2017 Quickfall
2018/0265338 A1 9/2018 Motley

OTHER PUBLICATIONS vehicleservicepros.com, Exclusive Vehicle Lift Guide, 16 pgs., 2013.

* cited by examiner

*Primary Examiner* — Minh Truong
(74) *Attorney, Agent, or Firm* — Wood Herron & Evans LLP

(57) ABSTRACT

A cable can be suspended from a mobile lift column. A bracket may be used and include one or more hangers on which the cables extending between the individual mobile lift columns may be suspended. In this way, the cables are elevated from the floor and work surface and no longer present a tripping hazard for personnel in the work area nor an obstacle over which equipment must roll during the servicing of the vehicle. Advantageously, the brackets may be individually mounted to each lift column as original equipment when the column is purchased or as a retrofit improvement to existing lift columns.

9 Claims, 10 Drawing Sheets

MOBILE LIFT COLUMN CABLE SUSPENSION BRACKET AND ASSOCIATED METHOD

This claims the benefit of U.S. Provisional Patent Application Ser. No. 62/501,964, filed May 5, 2017 and U.S. patent application Ser. No. 15/967,640, filed May 1, 2018, each of which is hereby incorporated by reference in its entirety.

BACKGROUND OF THE INVENTION

This invention relates to a coordinated lift system. In particular, this invention relates to a coordinated lift system having at least two lift mechanisms that communicate by signals carried by cables to coordinate the raising and lowering of a vehicle.

The need to lift a vehicle from the ground for service work is well established. For instance, it is often necessary to lift a vehicle for oil changes, brake inspections, exhaust work and other automotive maintenance. Traditionally, lifting a vehicle has been accomplished through the use of equipment that is built-in to the service facility. These built-in units are located at a fixed location at the service facility and adapted to contact the vehicle frame to lift the vehicle from the ground. However, built-in units are very expensive and sometimes impractical due to their lack of mobility.

To increase mobility and reduce the need to invest in permanent lifting equipment, a device commonly known as a mobile lift column was developed. Mobile lift columns are available from the owner of this invention, Ari-Hetra, www.ARI-HETRA.com. A set of mobile lift columns is typically used to independently engage each of the tires and lift the vehicle from the ground. To lift a vehicle in a generally level orientation with independent lift columns, a user must go back and forth between each lift column to incrementally raise each lift until the vehicle reaches the desired height or involve several people. While this type of lifting column is less expensive and provides more mobility than the built-in units, using a number of independent lift columns to lift the vehicle is a time consuming and tedious process.

Another type of system 1 for lifting a vehicle 3 using multiple lifting columns 5 is shown in FIG. 3 and includes a number of cables or wires 7 to connect the lifting columns 5 and allow communication among them to facilitate the coordinated operation and simultaneous lifting and lowering of the supported vehicle. The cables or wires 7 that are connected between the columns 5 allow the vehicle 3 to be raised or lowered in a uniform fashion. However, this system 1 also suffers from a number of drawbacks and deficiencies. For instance, the cables and wires 7 used to connect the individual columns extend across the floor 9 and are looped within the working area. The presence of the cables and lines 7 on the ground in the work area poses a tripping hazard to people working near the vehicle 3. Vehicles also often drive over these connecting cables 7 causing damage.

Some newer lifting systems utilize wireless communication among the individual lifting columns to coordinate their operation. However, such wireless systems are not an option in many cases due to the added cost of purchasing an entire set of lifting columns equipped with wireless communication capabilities. Many users are not willing to replace sets of existing and operational lift columns, but wish to alleviate the tripping and other hazards associated with the network of cables connecting the lifting columns.

Accordingly, there remains a need for a mobile lift system that is able to coordinate the raising or lowering of a vehicle with cables connecting the individual lift columns while avoiding the tripping and other hazards of such systems and doing so while still providing the benefits of mobile lift systems which allow for the re-positioning of the lift system from one location to another for subsequent lifting operations. This invention satisfies these and other needs.

SUMMARY OF THE INVENTION

In various embodiments, this invention is directed to hangers which may or may not be on a bracket which can be mounted to a mobile lift column. The bracket may include one or more hangers on which the cables extending between the individual mobile lift columns may be suspended. Alternatively, the hangers may be mounted to the mobile lift columns without the benefit of the brackets. With various embodiments of this invention, the cables are elevated from the floor and no longer present a tripping hazard for personnel in the work area nor an obstacle over which equipment must roll during the servicing of the vehicle. Advantageously, the brackets and/or hangers may be individually mounted to each lift column as original equipment when the column is purchased or as a retrofit improvement to existing lift columns.

Another advantage of various embodiments of this invention is the capability of suspending the cables between and among the various lift columns and having those lift columns communicate with one another for synchronized operation of the lift systems at one location and then, once that lift operation is completed, move the mobile lift columns to another location for subsequent lifting operations, which may be accomplished while the cables between and among the lift columns remain suspended from the lift columns.

According to various embodiments of a bracket according to this invention, one or more hangers may be included on each bracket. Each hanger may be mounted to the bracket or directly to the lift column and take the form of a pedestal having a head thereon extending from a portion of the bracket or lift column. The bracket may be generally L-shaped with a vertical leg of the L-shaped bracket extending downwardly from an upper end of the lift column and the horizontal leg of the bracket secured to the top portion of the lift column. The cable which allows for communication among the lift columns and coordinated operation thereof may be trained around one or more hangers and thereby elevated from the ground in the work area. Multiple hangers may be included on each lift column so as to generate sufficient friction between the hangers and the cable so that the cable does not slide relative to the lift column once it is suspended.

Another aspect of this invention is a method for suspending the cables between a set of multiple mobile lift columns. The method may include retrofitting a mobile lift column with a bracket having one or more hangers upon which the cable is suspended.

A further aspect of this invention is suspending the cables from the set of multiple mobile lift columns and then lifting a vehicle with the coordinated operation and communication afforded by the cables and then moving the lift columns and cables to another location for a subsequent lifting operation. The movement to another location may or may not be accomplished while the cables remain suspended between adjacent lift columns.

In various aspects of this invention, a set of multiple mobile lift columns may be utilized to lift a vehicle for service of the vehicle and alleviate a major source of injury and issues associated with the cable extending between the adjacent lift columns.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
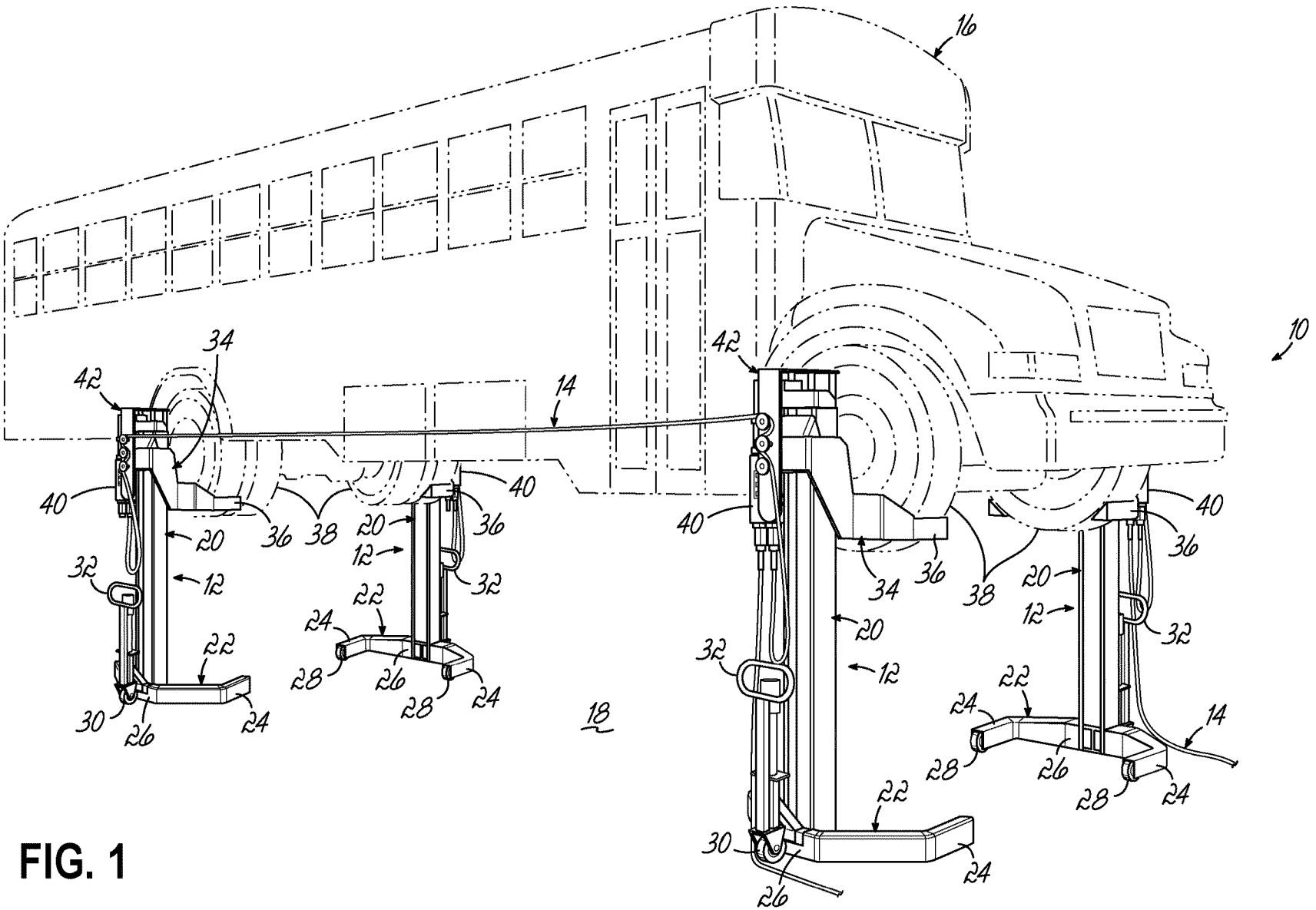
FIG. 1 is a perspective view of a vehicle raised off the ground by a number of lift columns and a cable extending serially among the lift columns is supported off of the ground by one or more hangers on a bracket on each lift column according to one aspect of this invention.

Referring now to the drawings in detail, and initially to FIG. 1, a lift system 10 constructed in accordance with a first embodiment of this invention is shown. Generally, the lift system 10 includes multiple lift columns 12, four of which are shown in FIG. 1, that communicate by signals carried by cables 14 to coordinate the movement of a vehicle 16 relative to a ground surface 18. Typically, the cables 14 carry electrical signals to and between the lift columns 12 and are flexible, bendable, ductile, slack and/or unable to support their own weight. It will be understood and appreciated that the number and type of lift columns 12 used in this invention may vary depending on the type of vehicle 16 being lifted. For instance, six lift mechanisms or columns may be used to lift a three-axle vehicle for service. Furthermore, it will be understood that this invention is not limited for use with lift systems for vehicles or any particular lift column, but also may be used to raise or lower other objects relative to the surface.

Each lift column 12 includes an upstanding post 20 supported by a base 22. The base includes a pair of legs 24 that are coupled to one another by a cross piece 26. The legs 24 and cross-piece 26 combine to form a U-shaped member. A pair of front wheels 28 are rotatably coupled with an end portion of the legs 24. Further, a rear wheel 30 is rotatably coupled adjacent to the cross piece 26. The wheels 28, 30 are adapted to allow each lift column 12 to be moved from location to location and rolled along the surface 18 and placed in a position to support the vehicle 16. A handle 32 is coupled to the wheel 30 and may be moved about a pivot point established adjacent to the wheel 30. The handle 32 may be used to place wheels 28, 30, in contact with the surface 18 so that the lift column 12 may be rolled into position. Once the lift column 12 is in position, the handle 32 may then be used to raise the wheels 28, 30, so that they are no longer in contact with the surface 18. The lift column 12 is thereby placed in a stable position for raising and lowering vehicle 16. Subsequently, the process may be repeated to move the lift column 12 to another location for another lifting operation.

The post 20 is mounted to the cross piece 26 and extends upwardly from the surface 18. The lifting column 12 also includes a carriage 34 that is slidably coupled to the post 20. Specifically, the carriage 34 engages a portion of the post 20 to enable the carriage 34 to move longitudinally with respect to the post 20. Carriage 34 further includes a pair of forks 36 that extend outwardly and are adapted to support a portion of vehicle 16. In particular, forks 36 are adapted to support the vehicle at each wheel 38, but it will be understood that carriage 34 may also be adapted to support the frame or any other portion of the vehicle 16. The carriage 34 may be moved relative to the post 20 using any of a variety of mechanisms known in the field.

As best seen in FIG. 1, each lift column 12 also includes a control box 40 that is adapted to communicate with the other control boxes 40 in the lift system 10 by signals carried by the cables 14 to coordinate the raising and/or lowering of the vehicle 16.

Figure 2:
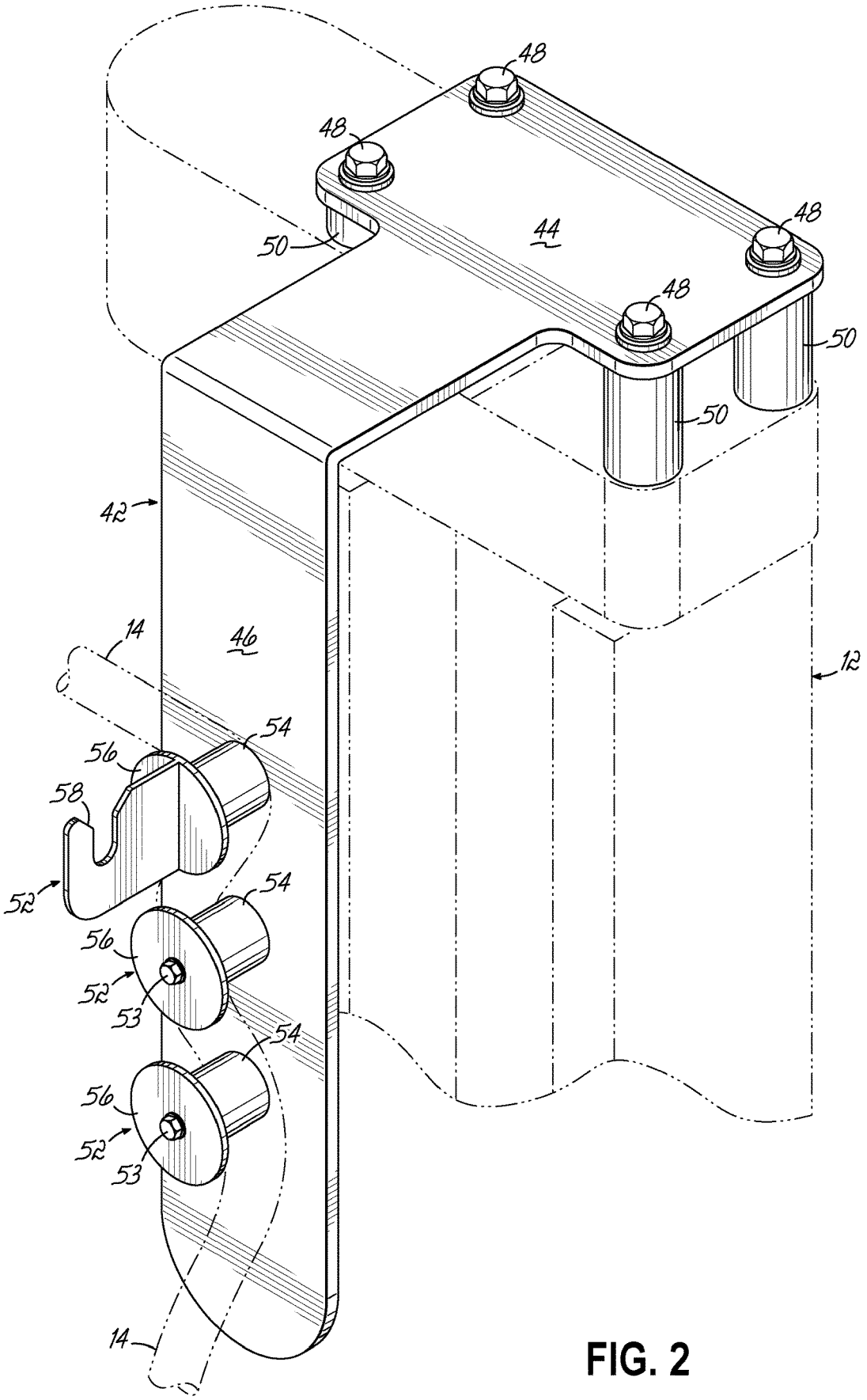
FIG. 2 is a perspective view of one embodiment of the bracket mounted on a lift column and suspending a cable on hangers on the bracket according to this invention.

As shown in FIGS. 1 and 2, one aspect according to embodiments of this invention is a bracket 42 which is mounted to each lift column 12 in the lift system 10. In one embodiment, the bracket 42 has a generally L-shaped configuration with a first leg 44 of the bracket 42 being generally parallel to the ground 18 and a second leg 46 of the bracket 42 extending downwardly in a perpendicular direction. The first leg 44 of the bracket 42 is a mount for selectively and/or releasably mounting the bracket 42 to an upper end of the lift column 12 via four bolts 48. The bracket 42 may be supported atop the lift column 12 by one or more spacers 50 positioned between the bracket 42 and the top of the lift column 12 as shown particularly in FIG. 2. The generally vertical second leg 46 of the bracket 42 extends downwardly from the first leg 44 and includes one or more hangers 52 adapted to support the cable 14 in a taut or tightly drawn configuration between the lift columns 12. In the embodiment shown in FIGS. 1 and 2, each bracket 42 includes three vertically spaced hangers 52. In one embodiment, the hanger 52 may have a mount or pedestal 54 extending perpendicularly from the leg 46 of the bracket 42. The hanger 52 may also include a disk-shaped cap 56 having an outer dimension greater than the pedestal 54 to inhibit the cable 14 from sliding off the pedestal 54. The hanger 52 may have a friction engaging surface on the pedestal 54 or elsewhere to inhibit the cable 14 from sliding off of the hanger 52.

One or more of the hangers 52 may comprise a hook 58. The hook 58 may be used for a variety of functions, including a support by which a length of the cable 14 may be suspended. While one embodiment of a hanger 52 according to this invention is shown and described, the hanger may take any of a variety of other forms, including, but not limited to, a cable grip, a cable pull, a hook, a ball stop, any of a variety of cleats (fixed, pinch, jamming, etc.), a horn, or any device capable of constraining movement of the cable 14 and/or adjusting the tension on the cable 14.

Figure 4:
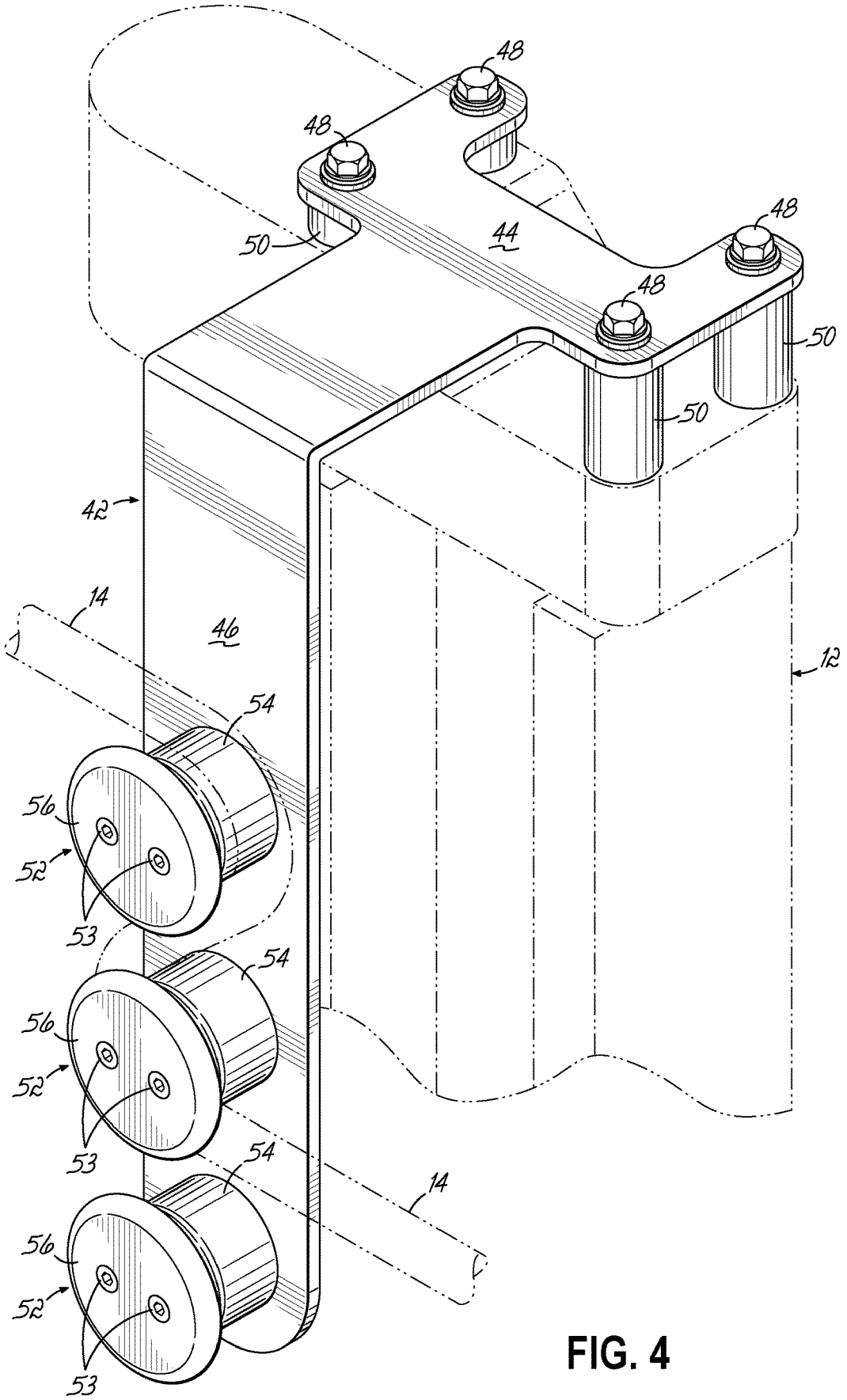
FIG. 4 is a view similar to FIG. 2 of an alternate embodiment of the hangers and bracket of this invention.
Figure 4A:
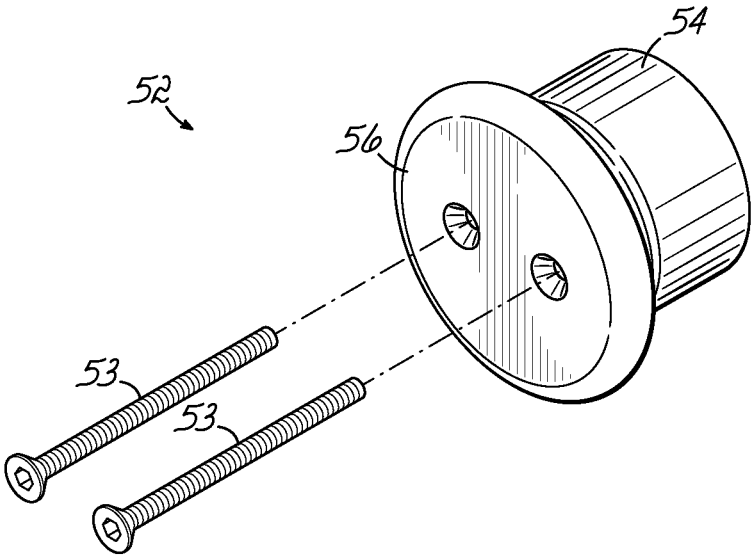
FIGS. 4A and 4B are perspective exploded and side elevational views of one embodiment of a hanger according to this invention.
Figure 4B:
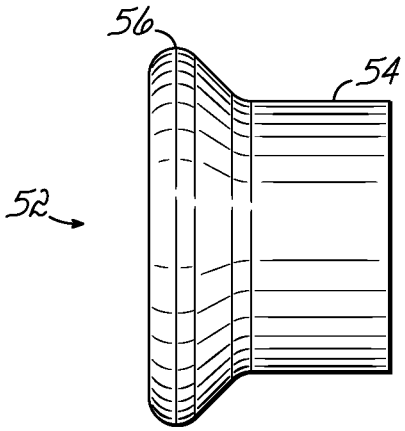
Figure 4C:
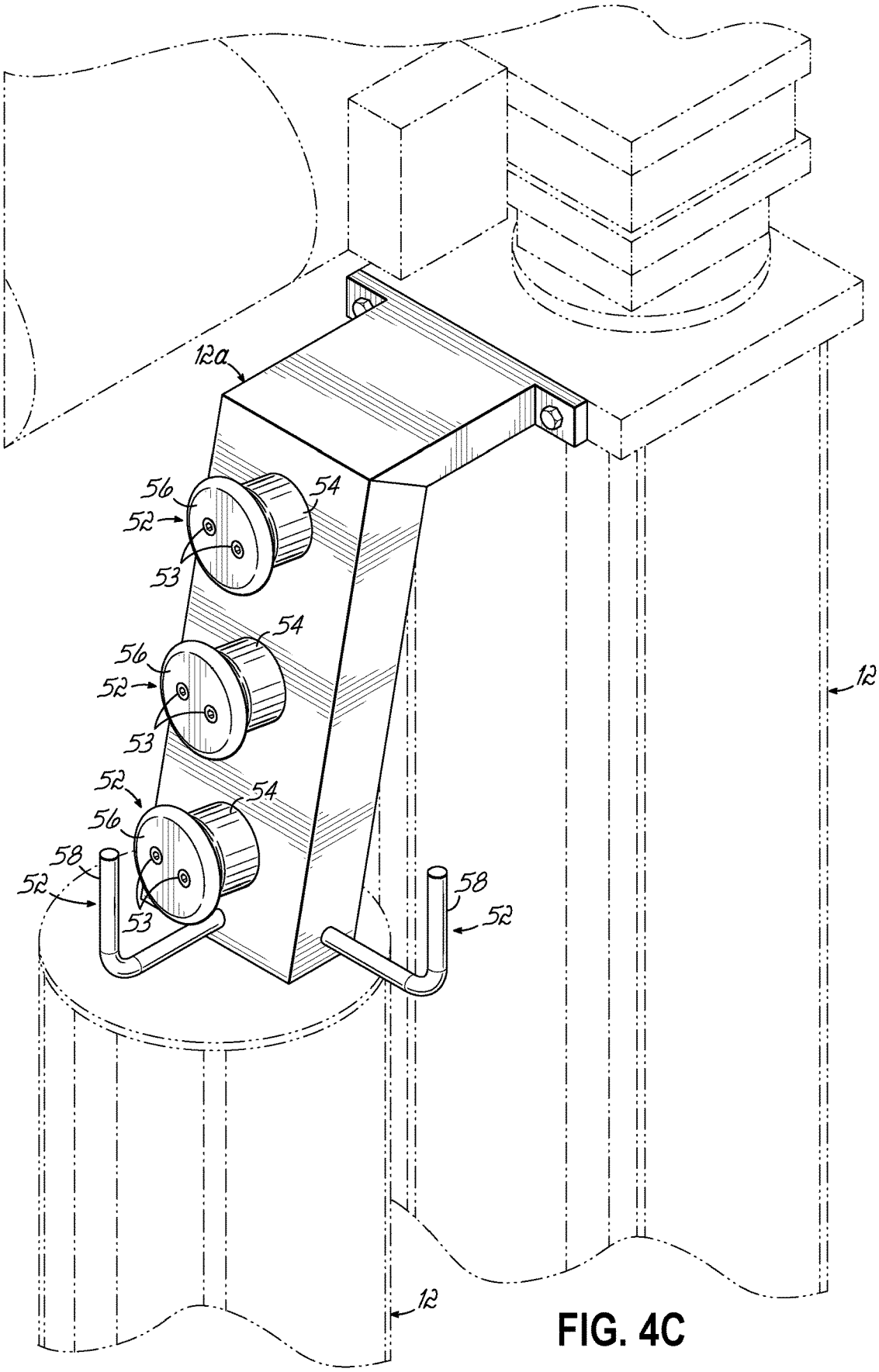
FIG. 4C is a perspective view of hangers according to various embodiments of this invention mounted onto an exemplary mobile lift column.

Moreover, the hangers 52 may be in the form of the pedestal 54 and cap 56, the hook 58 or another configuration as noted above. Further, the hangers 52 and/or hooks 58 may be mounted directly to the lift column 12 or a component 12*a* thereof without the bracket 42 as shown in FIG. 4C. The hangers 52 which are adapted to be mounted directly to the lift column 12 or component thereof 12*a* are shown in one embodiment in FIGS. 4A-4B. Mounting screws 53 may extend through holes in the cap 56 and/or pedestal 54 and be used to mount the hangers 52 to the lift column 12 or component thereof 12*a*.

In a further embodiment, the system may include a reel, powered or otherwise, mounted to the lift column 12 to harness the cable 14 as needed and keep it off the ground 18. Other embodiments of this invention may utilize various versions of the following within the scope of this invention: cable constraints; cleats; friction-based devices to suspend cables; a ball cock around the cable for holding cables in elevated position; one or more hooks added to the post; any gripping methods that latch to cables for the purpose of suspending the cable overhead; quick release cable grips; additions to the post for the purpose of suspending or draping cables overhead; a reel to tension cables overhead; commutator devices used for the purpose of tensioning cables to be suspended overhead; pinch cleats and/or rope or other material tied to cable to create tension for the purpose of suspending cables overhead.

In one embodiment, the hangers 52 are spaced vertically from one another so that the cable 14 may be trained around the pedestals 54 of the respective hangers 52 as shown particularly in FIG. 2. One advantage of multiple hangers 52 is to increase the friction between the hangers 52 and the cable 14 to minimize or eliminate the likelihood that the cable 14 will slip relative to the hanger 52.

One advantageous feature of various embodiments of this invention is that the bracket 42, hangers 52 and/or hooks 58 is that they may be added to existing lift columns 12 as a retrofit addition thereto. Alternatively, the brackets 42, hangers 52 and/or hooks 58 may be provided as original equipment with newly purchased lift columns 12.

Figure 3:
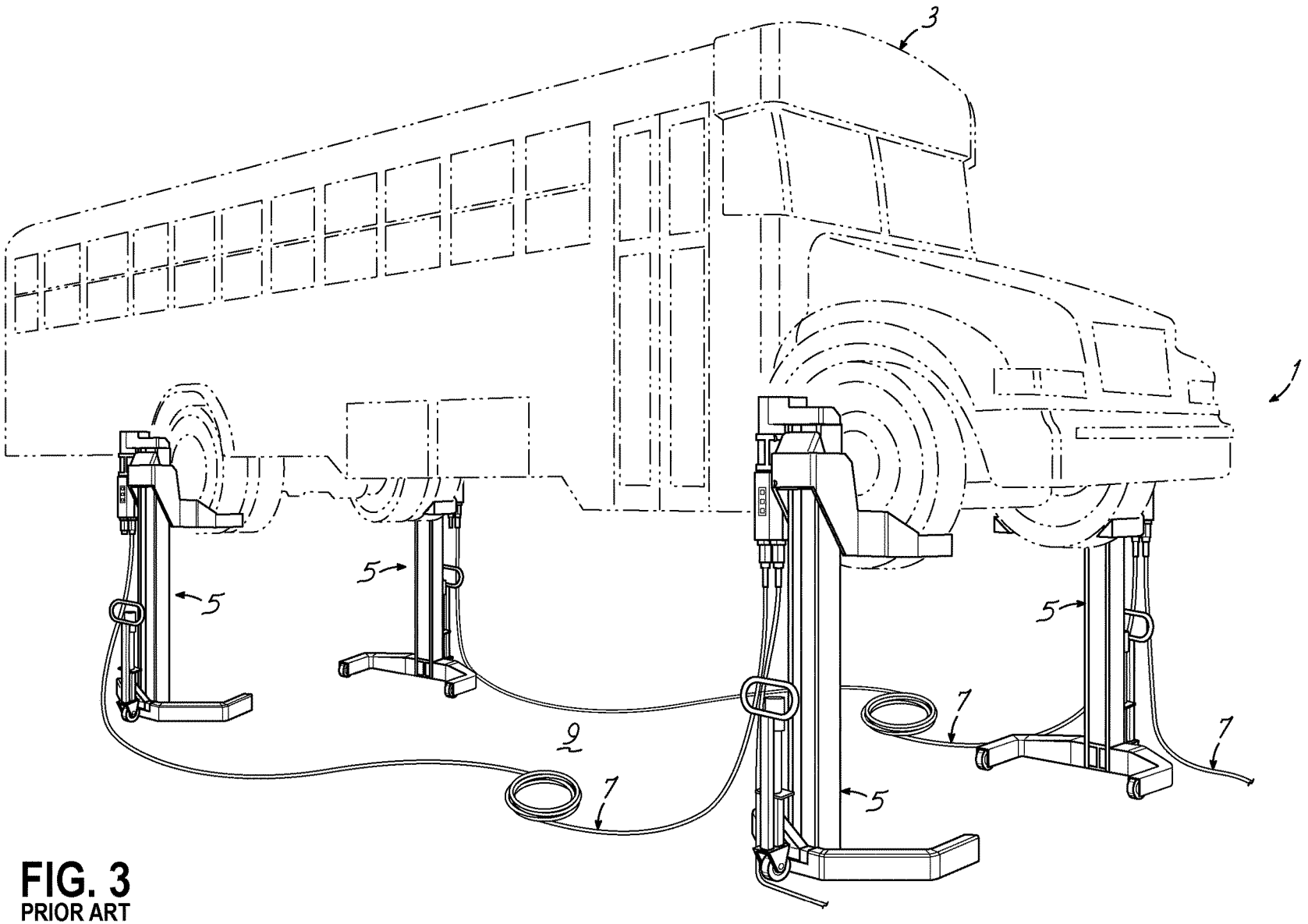
FIG. 3 PRIOR ART
FIG. 3 is a perspective view of a prior art arrangement for a lift system with the cable connecting the lift columns for communication among the lift columns laying on the ground.

As a result of the brackets 42 and hangers 52, the cable 14 may be serially mounted to the lift columns 12 and suspended off the ground 18 as shown particularly in FIG. 1. Comparison of the cable arrangements of FIG. 1 relative to FIG. 3 shows that the tripping hazard is significantly reduced and/or eliminated with the cable suspension system according to this invention as shown in FIG. 1 for personnel servicing the vehicle. Likewise, equipment can be readily driven or rolled between the lift columns 12 for servicing the vehicle 16 without interference by the cable 14 on the ground 18 according to various embodiments of this invention. While the lift columns 12 have been described and shown herein as being mobile, this invention extends to include systems with one or more fixed lift columns.

In FIGS. 5A-5D another aspect of this invention is shown in which a first and a second vehicle 16*a*, 16*b* are positioned at first and second locations 17*a*, 17*b*, respectively. A number of mobile lift columns 12, four of which are shown, are positioned proximate the first vehicle 16*a* at the first location 17*a*. The lift columns 12 are connected by one or more cables 14 which lay on the ground surface 18 proximate the first vehicle 16*a* at the first location 17*a* in FIG. 5A.

Figure 5A:
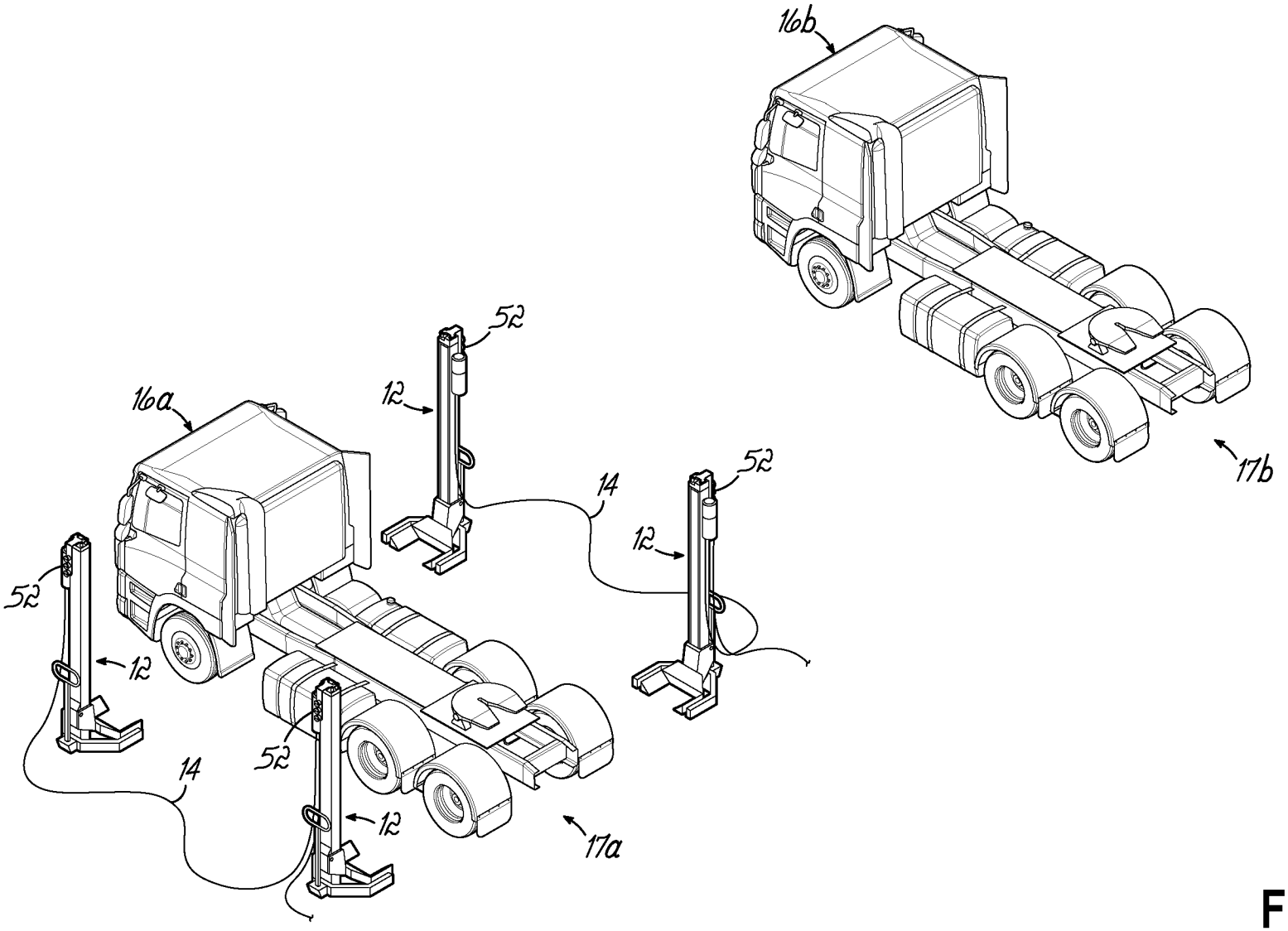
FIGS. 5A thru 5D are sequential perspective views of a mobile lift system according to one aspect of this invention with the cables extending between and among mobile lift columns being suspended for the lifting operation of a first vehicle at a first location and then being relocated and used for a subsequent lifting operation of a second vehicle at a second location.
Figure 5B:
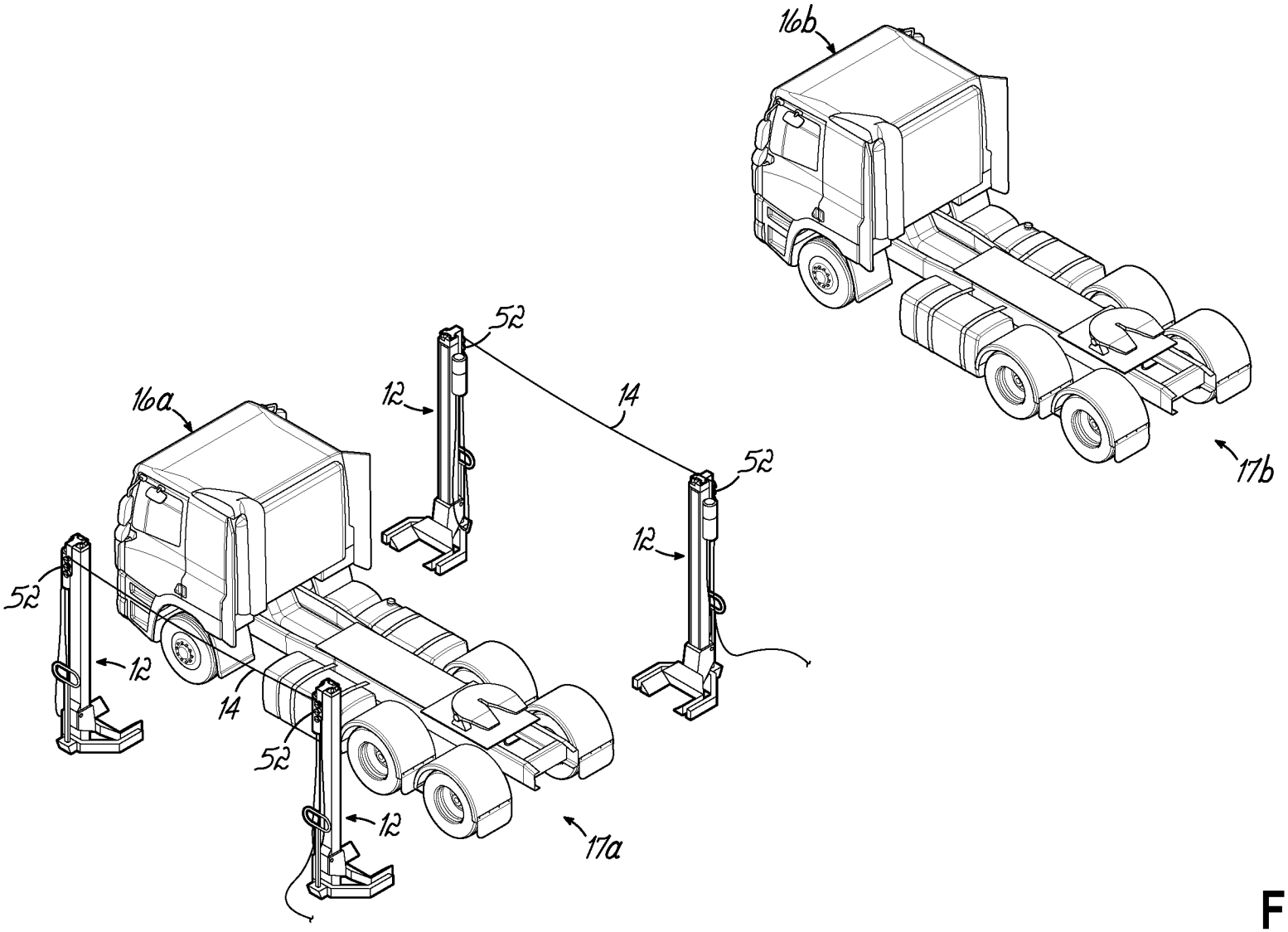

Subsequently as shown in FIG. 5B, the cables 14 are suspended off of the ground surface 18 and on the hangers 52 mounted on the respective lift columns 12 for the first vehicle 16*a* at the first location 17*a*. The lift columns 12 are then moved into position for lifting the first vehicle 16*a* at the first location 17*a*. The lift columns 12 may be moved to engage the wheels 38 and lift the vehicle 16*a*. The first vehicle 16*a* may then be serviced at the first location 17*a* without interference by the cables 14 on the ground surface 18.

Figure 5C:
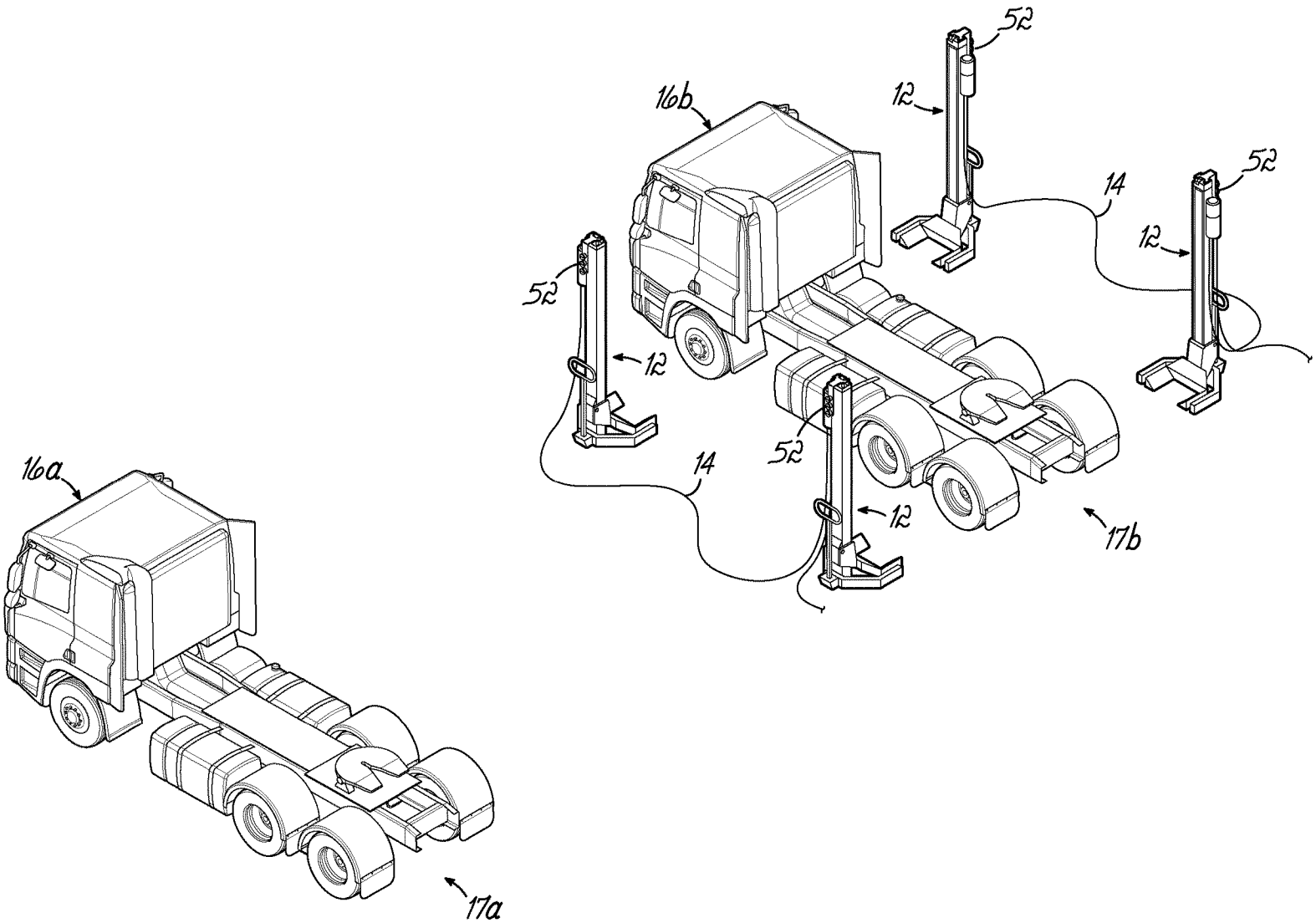

In FIG. 5C, the lift columns 12 have been moved or relocated to the second location 17*b* proximate the second vehicle 16*b* to be lifted for service. After the first vehicle 16*a* has been serviced, the lift columns 12 are moved to the second location 17*a* while the cables 14 remain suspended on the hangers 52 of the lift columns 12 or the cables 14 may be disengaged from the hangers 52 and once again placed on the ground surface 18 for re-location of the lift columns 12 to the second location 17*b*.

Figure 5D:
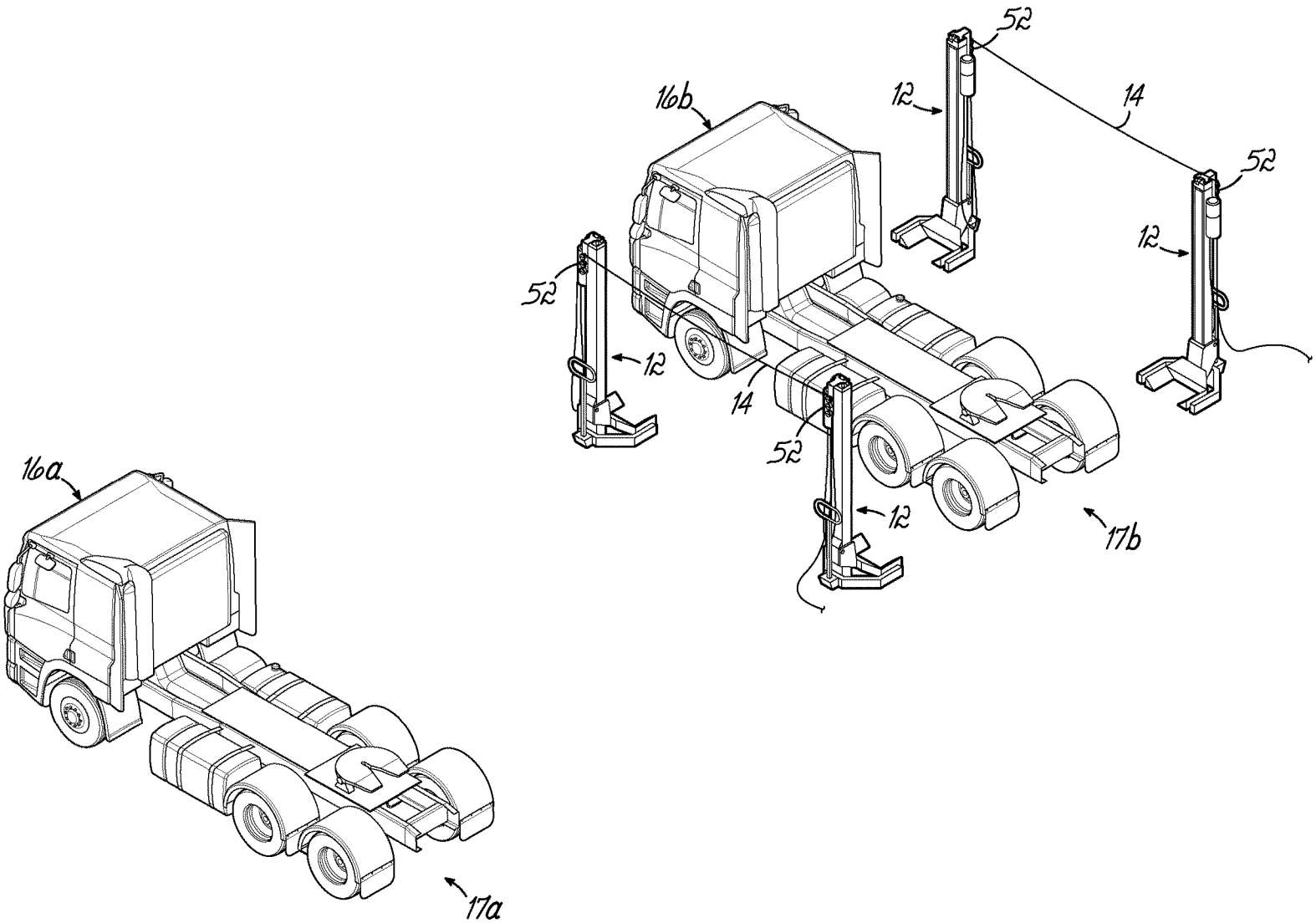

As shown in FIG. 5D, the cables 14 are or remain suspended from the hangers 52 on the lift columns 12 at the second location 17*b* for service of the second vehicle 16*b*. The lift columns 12 may be moved to engage the wheels 38 and lift the vehicle 16*b*. As such, the mobility of the lift columns 12 is utilized to conveniently service vehicles 16 at multiple locations while still benefiting from this invention by suspending the cables 14 off of the ground surface 18 and on the respective hangers 52 on the lift columns 12.

From the above disclosure of the general principles of this invention and the preceding detailed description of at least one embodiment, those skilled in the art will readily comprehend the various modifications to which this invention is susceptible. Therefore, I desire to be limited only by the scope of the following claims and equivalents thereof.

I claim:

1. A mobile lifting system comprising:

a plurality of lift columns each adapted to support a portion of a vehicle off the ground;

a cable extending between and among the plurality of lift columns, the cable being adapted for transmitting electrical signals to and between the plurality of lift columns to synchronize a lifting operation of the plurality of lift columns; and a plurality of hangers each mounted to an upper end of one of the lift columns and the cable being frictionally suspended on the hangers and extending between adjacent ones of the plurality of lift columns and off the ground;

wherein each of the plurality of hangers is selectively mounted to one of the lift columns.

2. The mobile lifting system of claim 1 wherein each of the plurality of lift columns further comprises:

a bracket on which each of the associated hangers is mounted.

3. The mobile lifting system of claim 2 wherein each bracket further comprises a plurality of the hangers.

4. The mobile lifting system of claim 1 wherein each hanger further comprises at least one of a pedestal, a cap and a hook.

5. The mobile lifting system of claim 1 wherein the cable is suspended off of the ground to and between a first, second, third and fourth lift column of the plurality of lift columns with at least the first and fourth lift columns being positioned on opposite sides of the vehicle.

6. A plurality of hangers each for use on one of a plurality of mobile lift columns adapted to support a portion of a vehicle off the ground, a cable being supported by adjacent ones of the plurality of hangers off the ground for carrying electrical signals for communication with other mobile lift columns to synchronize a lifting operation of the mobile lift column, each of the plurality of hangers comprising:

a mount for selectively mounting the hanger to an upper end of the associated mobile lift column; and a frictionally engaging surface for receiving the cable and suspending the cable off the ground.

7. The plurality of hangers of claim 6 wherein each of the plurality of lift columns further comprises:

a bracket on which each of the associated hangers is mounted.

8. The plurality of hangers of claim 7 wherein multiple of the plurality of hangers are mounted on the bracket.

9. The plurality of hangers of claim 6 wherein each of the plurality of hangers further comprises at least one of a pedestal, a cap and a hook.

* * * * *